US006520630B1

(12) United States Patent
Oda et al.

(10) Patent No.: US 6,520,630 B1
(45) Date of Patent: Feb. 18, 2003

(54) INK JET RECORDING APPARATUS

(75) Inventors: Kazuyuki Oda, Ebina (JP); Ichiro Tomikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/651,724

(22) Filed: Aug. 30, 2000

(30) Foreign Application Priority Data

Dec. 28, 1999 (JP) ..... 11-375387

(51) Int. Cl.[7] ..... B41J 2/175
(52) U.S. Cl. ..... 347/85
(58) Field of Search ..... 347/7, 84, 85, 347/86, 87

(56) References Cited

U.S. PATENT DOCUMENTS

| | | | | | |
|---|---|---|---|---|---|
| 5,815,172 | A | | 9/1998 | Moh | 347/14 |
| 5,905,518 | A | * | 5/1999 | DeFilippis | 347/85 |
| 5,912,687 | A | | 6/1999 | Cowger et al. | 347/85 |
| 6,012,795 | A | * | 1/2000 | Saito et al. | 347/7 |
| 6,022,102 | A | * | 2/2000 | Ikkatai et al. | 347/85 |

FOREIGN PATENT DOCUMENTS

| | | | | |
|---|---|---|---|---|
| JP | 54-31898 | | 10/1979 | |
| JP | 63-51868 | | 10/1988 | |
| JP | 4-10946 | | 1/1992 | |
| JP | 5-57902 | | 3/1993 | |
| JP | 405096744 | * | 4/1993 | 347/86 |
| JP | 5-177844 | | 7/1993 | |
| JP | 7-17046 | | 1/1995 | |
| JP | 7-81084 | | 3/1995 | |
| JP | 7-51356 | | 6/1995 | |
| JP | 9-187967 | | 7/1997 | |
| JP | 10-29318 | | 2/1998 | |
| JP | 2772014 | | 4/1998 | |
| JP | 10-128992 | | 5/1998 | |
| JP | 2929804 | | 5/1999 | |

* cited by examiner

*Primary Examiner*—Anh T.N. Vo
(74) *Attorney, Agent, or Firm*—Morgan, Lewis & Bockius LLP

(57) ABSTRACT

Disclosed herein is an ink jet recording apparatus which supplies a suitable amount of ink to a main ink tank for supplying ink to a recording head. The main ink tank placed over a movable carriage includes a first ink chamber which holds ink therein in a free state together with air. The main ink tank communicates with a sub-ink tank attached to its upper portion through a pipe. Ink in a sub-ink chamber of the sub-ink tank forms an interface with air by a surface tension at the pipe. When the sub-ink tank is scanned by the movable carriage in this condition, acceleration acts on the ink in the first ink chamber and the sub-ink chamber. As a result, the air in the sub-ink chamber 81 and the ink in the first ink chamber are interchanged with each other at the interface according to a change in pressure of the first ink chamber, whereby the ink is supplied from the sub-ink chamber to the first ink chamber.

13 Claims, 12 Drawing Sheets

INK JET RECORDING APPARATUS

BACKGROUND OF THE INVENTION

1. Field of the Invention

The present invention relates to an ink jet recording apparatus wherein an ink tank for supplying ink to a recording head is placed over a movable carriage.

2. Description of the Related Art

A structure for supplying ink to a recording head has heretofore been proposed for an ink jet recording apparatus in various ways.

For example, Japanese Published Examined Patent Application No. Sho 54-31898 (hereinafter called "prior art example 1") discloses a structure wherein a liquid storage of a print head is charged with a liquid absorption material and a charging opening fit with a liquid charging device is provided and brought into contact with a wick provided in the liquid charging device, whereby liquid is supplied to the print head by a capillary force.

Japanese Published Examined Patent Application No. Sho 63-51868 (hereinafter called "prior art example 2") also discloses a structure wherein a supply pipe connects between a sub tank mounted to a carriage and a main ink tank provided outside the carriage, and when ink in the sub tank is reduced, the main ink tank is pressed to feed the ink to within the sub tank under pressure, whereby air in the sub tank is stored in a bag-like container through an exhaust pipe.

Further, Japanese Published Examined Patent Application No. Hei 7-51356 (hereinafter called "prior art example 3") discloses a structure wherein a first tank placed over a carriage and a second tank provided outside the carriage are connected to each other by two connecting pipes corresponding to first and second connecting pipes to feed ink from the second tank to the first tank under pressure, and overflowing ink is withdrawn into the second tank. Incidentally, pressure maintenance is effected on a nozzle orifice by pressure applied at this time.

Furthermore, Japanese Published Examined Patent Application No. 2772014 (hereinafter called "prior art example 4") discloses a structure wherein when a remaining-amount-of-ink detection electrode of a first ink tank placed on a carriage detects a reduction in the remaining amount of ink, a mechanical valve of a tube connecting the first ink tank and a second ink tank is opened, so that ink is automatically resupplied from the second ink tank located at a position higher than that of the first ink tank.

Still further, Japanese Published Examined Patent Application No. 2929804 (hereinafter called "prior art example 5") discloses a structure wherein in an ink supply mechanism configured so as to allow separation between a head cartridge unit and an ink cartridge unit, the head cartridge unit has a first chamber having an opening defined therein for communication with air and a second chamber in communication with the first chamber and having a porous member, and is joined with the ink cartridge unit by two or more communication paths having a height difference within the first chamber, whereby ink is supplied from the ink cartridge unit according to differential pressure based on the height difference.

Still further, Japanese Published Unexamined Patent Application No. Hei 4-10946 (hereinafter called "prior art example 6") discloses a structure provided with a pump mechanism in which a first ink tank communicating with a nozzle of a ink jet printer and a second ink tank communicating with the first ink tank are both placed on a carriage and which has a piston idly movable in a reciprocating direction according to the inertia incident to reciprocation motion of the carriage and performs the transfer of ink between the first ink tank and the second ink tank according to the actuation of the piston.

Japanese Published Unexamined Patent Application No. Hei 5-57902 (hereinafter called "prior art example 7") discloses a structure wherein an ink jet head cartridge is provided in which a recording head and an ink storage unit are integrally formed, an ink re-filling cartridge filled with replenishing ink is connected to the head cartridge, and the recording head is sucked under negative pressure to thereby replenish the head cartridge with the ink in the ink re-filling cartridge.

Japanese Published Unexamined Patent Application No. Hei 5-177844 (hereinafter called "prior art example 8") discloses a structure wherein an ink flight unit is provided integrally with an ink cartridge detachably mounted to a cartridge, an ink spare cartridge for refilling the ink cartridge with ink is removably provided, and the junction between the ink cartridge and the ink spare cartridge is made by capillary or tubing.

Japanese Published Unexamined Patent Application No. Hei 7-17046 (hereinafter called "prior art example 9") discloses a structure wherein a print head, an ink tank for replenishing ink, and a pump for delivering ink from the replenishing ink tank are mounted on a carriage, and the pump is actuated based on a signal detected by a remaining-of-amount-of-ink detector attached to the print head to supply the ink.

In Japanese Published Unexamined Patent Application No. Hei 9-187967 (corresponding to U.S. Pat. No. 5,815,172)(hereinafter called "prior art example 10") and Japanese Published Unexamined Patent Application No. Hei 10-128992 (hereinafter called "prior art example 11"), a structure is disclosed wherein a print cartridge replaceable with a cartridge is placed and connected to an ink supply unit placed within a printer through an ink tube. Further, a structure is disclosed wherein a pump chamber for pressurizing an ink supply unit is provided and a print cartridge is provided with a pressure control valve, whereby ink is supplied to a print head under suitable negative pressure.

U.S. Pat. No. 5,912,687 (hereinafter called "prior art example 12") discloses a structure wherein a nozzle for replenishing ink is elongated and joined to a print head placed on a carriage to supply pressurized ink from an in ink cartridge.

Japanese Patent Unexamined Patent Application No. Hei 10-29318 (hereinafter called "prior art example 13") discloses a method of replenishing a liquid storage container having a first chamber holding a negative pressure generating member therein and having an opening in communication with the outside, and a second chamber which communicates with the first chamber through a communication portion and defines a hermetically sealed space, with liquid by using a replenishing container, i.e., a structure wherein gas in the second chamber and gas in the replenishing container, and liquid in the second chamber and liquid in the replenishing container are allowed to communicate with one another through different paths respectively. This discloses that the pressure of the gas in the second chamber and the pressure of the gas in the replenishing container are balanced by causing the gases to communicate with each other in this way, and the liquids are respectively supplied so as to reach a predetermined liquid surface or level by the difference in head pressure.

Incidentally, one example in which an ink chamber for supplying ink to a recording head is brought to a predetermined vacuum state, has been disclosed in Japanese Published Unexamined Patent Application No. Hei 7-81084. Namely, this discloses that a sub-ink chamber for holding an ink absorption member communicates with a main ink chamber through a meniscus formation member having a small hole defined therein and thereby ink is supplied from the ink absorption member to the main ink chamber through the meniscus formation member when negative pressure increases with the consumption of ink in the main ink chamber, thereby maintaining the negative pressure. This also discloses that after all the ink in the ink absorption member are used up, a suitable amount of air (bubbles) is supplied through an ink meniscus film formed on the meniscus formation member to thereby keep the negative pressure of the main ink chamber constant.

The respective prior art examples involving the following inconveniences.

The prior art example 1 has the inconvenience that the satisfactory transfer of ink is not performed depending on the condition of a distribution of liquid in the liquid storage, and since the wick is always exposed, the liquid is apt to cause evaporation and modification.

The prior art example 2 has the inconvenience that the sub tank is brought to positive pressure upon feeding of the ink under pressure and the positive pressure acts on an orifice of a recording head, thereby causing the leakage of the ink.

The prior art example 3 has the inconvenience that the first tank is required to be placed below a head and the ink is apt to leak from the connected portion by the pressure maintenance.

The prior art example 4 has the inconvenience that when the mechanical valve is deteriorated, the ink leaks.

The prior art example 5 has the risk of causing the leakage of ink from the air communication hole because the first chamber is open to air, when the position of the head cartridge unit is changed.

The prior art example 6 is accompanied by a problem that is actually difficult to fabricate a piston pump idly movable by the reciprocation of the carriage (very small in operating resistance), and even if it is possible to fabricate the piston pump, it is brought to a complex mechanism, thus causing an increase in cost.

The prior art example 7 is accompanied by a problem that the recording head needs to be subjected to a vacuum state and the ink absorbed from the recording head at this time results in useless waste ink. A problem also arises in that the amount of ink with which the head cartridge can be refilled, cannot be controlled accurately.

The prior art example 8 is accompanied by a problem that while a sponge is placed within the ink cartridge as a member for supplying suitable negative pressure to a head, the pressure supplied to the head will change because the amount of ink stored in the sponge changes according to the amount of ink re-supplied from the ink spare cartridge. Also a problem arises in that when the coupling between the capillary or tubing and the sponge by fluid is rendered unstable even a bit, the simple absorption of air from an air communication hole makes is impossible to use the ink in the ink spare cartridge.

The prior art example 9 is accompanied by a problem that since the pump is required between the print head and the ink tank, an apparatus scales up and increases in cost. It has the inconvenience that the weight of the carriage also increases.

The prior art examples 10 and 11 are respectively accompanied by a problem that since the pressure pump chamber for the ink tube and the ink supply unit, the pressure control valve for the print cartridge, etc. are so complicated in system, they increase in cost for their implementation and an apparatus increases in size.

According to the prior art example 12, there is a fear of the leakage of ink from a connecting portion because the ink is supplied by pressurization. It is also necessary to accurately control the amount of ink to be replenished.

In the prior art example 13, the position of placement of the replenishing container is restricted because it is necessary to provide a mechanism for allowing the liquids and gases in the first and second chambers to always communicate with one another. It is also necessary to provide a long gas communication pipe for the purpose of allowing the gases to communicate with each other. Further, difficulties are encountered in fabricating and placing such a communication pipe, and irregular ink enters into the long gas communication hole. As a result, a problem arises in that ink's meniscus interferes with the balance in pressure between the gases and no ink is replenished from the replenishing container.

SUMMARY OF THE INVENTION

The present invention has been made to solve the inconveniences and provides an ink jet recording apparatus which is compact in structure and replenishes a suitable amount of ink.

According to one aspect of the present invention, there is provided an ink jet recording apparatus including a main ink tank which is placed over a movable carriage provided with a print recording head and has a first ink chamber which holds ink supplied to the recording head therein in a state having a free surface, a sub-ink tank having a sub-ink chamber with ink held therein, and at least one connecting unit having at least one communication path which allows the first ink chamber and the sub-ink chamber to communicate with each other, and wherein air in the first ink chamber and the ink in the sub-ink chamber are interchanged with each other through the communication path according to a change in pressure in the first ink chamber, which is developed by acceleration or deceleration based on scanning of the movable carriage, whereby the ink is supplied from the sub-ink tank to the main ink tank.

When the movable carriage is scanned upon printing, a force proportional to the mass of ink acts on the ink held in the main ink tank to thereby change pressure applied to the ink in the main ink tank. The change in pressure swings a free surface of ink and produces an irregular pressure distribution developed by the swing of the ink's free surface, within the main ink tank.

When, at this time, pressure acts even on the communication path (interface between air and ink) between the main ink tank and the sub-ink tank and thereby the pressure in the main ink tank relatively increases, air stored above the main tank is discharged into the sub-ink tank. When the pressure in the sub-ink tank rises in reverse, ink placed below the sub-ink tank is discharged into the main ink tank. Owing to the repetition of such action according to the scanning of the carriage, the air stored in the main ink tank ad the ink in the sub-ink tank are interchanged with each other.

Namely, the ink is supplied from the sub-ink tank to the main ink tank by the printing operation to compensate for the consumption of ink in the first ink chamber by printing. Accordingly, a special driving unit or the like for the supply of ink is not required and thereby the present apparatus can be simplified in structure.

According to another aspect of the present invention, there is provided an ink jet recording apparatus wherein the connecting unit has plural communication paths, and the air in the first ink chamber and the ink in the sub-ink chamber are interchanged with each other according to a difference or differential pressure between respective head pressures developed in the plural communication paths to thereby supply the ink from the sub-ink tank to the main ink tank.

Plural communication paths for allowing the sub-ink chamber and the first ink chamber to communicate with each other are provided and a differential pressure is developed between ink's head pressures developed in the communication paths.

Since, at this time, the differential pressure is applied to the change in pressure developed by the scanning (acceleration) of the carriage, the air in the main ink tank and the ink in the sub-ink tank can be exchanged smoother with one another.

Thus, the ink can be supplied from the sub-ink tank to the main ink tank with more reliability without a special supply unit owing to the provision of the plural communication paths and the use of the deferential pressure between their head pressures.

According to a further aspect of the present invention, there is provided an ink jet recording apparatus wherein the plural communication paths have height differences at open ends in the first ink chamber.

By allowing the plural communication paths to have the height differences at the open ends in the first ink chamber, the difference or differential pressure occurs between the respective head pressures developed in the plural communication paths.

Thus, the ink can be supplied from the sub-ink tank to the main ink tank according to the developed differential pressure.

According to a still further aspect of the present invention, there is provided an ink jet recording apparatus wherein the sub-ink tank is placed over the movable carriage and detachably mounted to the main ink tank.

Since the sub-ink tank is also placed over the movable carriage and detachably mounted to the main ink tank, the sub-ink tank is replaced with another when the remaining amount of ink in the first ink chamber is reduced, whereby the main ink tank can be used continuously. Accordingly, the recording head formed integrally with the main ink tank can be utilized until it is put out of action.

According to a still further aspect of the present invention, there is provided an ink jet recording apparatus wherein the main ink tank has a negative pressure control unit which controls the first ink chamber for supplying ink to the print recording head to a predetermined vacuum state.

Since the first ink chamber is controlled to the predetermined vacuum state by the negative pressure control unit, it is possible to restrain or control an increase in negative pressure in the first ink chamber due to the consumption of ink and reliably prevent the occurrence of leakage of ink due to the action of positive pressure on the recording head. Accordingly, satisfactory printing is made possible.

According to a still further aspect of the present invention, there is provided an ink jet recording apparatus wherein the negative pressure control unit includes a second ink chamber which absorbs the ink in the first ink chamber, corresponding to expansion of air in the first ink chamber and sub-ink chamber at a change in ambient environment while the vacuum state is being kept.

The ink jet recording apparatus has the fear of expanding the air in the first ink chamber and sub-ink chamber due to the change in ambient environment, e.g., a rise in ambient temperature and thereby reducing the negative pressure in the first ink chamber. The extreme case was that the first ink chamber was brought to the positive pressure to thereby cause the leakage of the ink from the recording head. In the present invention, however, the vacuum state of the first ink chamber can be maintained because the ink in the first ink chamber, corresponding to the expansion of air in the first ink chamber and sub-ink chamber due to the change in ambient environment is absorbed into the second ink chamber by the negative pressure control unit.

According to a still further aspect of the present invention, there is provided an ink jet recording apparatus wherein the negative pressure control unit includes a capillary member for holding ink therein, a second ink chamber which holds the capillary member therein and has an air communication hole, and a meniscus formation member which is placed at a portion where the first ink chamber and the second ink chamber communicate with each other, and forms ink meniscus.

The main ink tank is provided with the second ink chamber, which communicates with the first ink chamber through the meniscus formation member and has the air communication hole. Therefore, when the liquid level of ink in the first ink chamber is lowered by printing, the ink is supplied from the capillary member of the second ink chamber to the first ink chamber through the meniscus formation member owing to increased negative pressure of the first ink chamber, whereby the vacuum state of the first ink chamber can be maintained at a suitable level. When the negative pressure of the first ink chamber increases after the ink in the second ink chamber is fully used up (air has reached the meniscus formation member), an ink meniscus film formed on the meniscus formation member is broken to supply bubbles (air) from the second ink chamber to the first ink chamber, whereby the negative pressure of the first ink chamber is controlled to a predetermined range. Further, when the pressure of the first ink chamber increases due to the change in ambient environment, the ink is absorbed into the interior of the capillary member of the second ink chamber through the meniscus formation member, thereby making it possible to maintain the negative pressure within the predetermined range.

According to a still further aspect of the present invention, there is provided an ink jet recording apparatus wherein a negative-pressure maintainable capacity of the second ink chamber is defined as Xm1 and the amount of expansion of the air in each of the first ink chamber and the sub-ink chamber at the change in ambient environment is defined as Ym1, both satisfy the relations in $X \geq Y$.

If the negative-pressure maintainable capacity of the second ink chamber, e.g., an ink absorbable capacity of the capillary member is set so as to be greater than the expansion of air in each of the first ink chamber and sub-ink chamber due to the change in ambient environment, then a change in the negative pressure of the first ink chamber can reliably be controlled to a predetermined range and hence satisfactory printing can be ensured.

According to a still further aspect of the present invention, there is provided an ink jet recording apparatus further including a ink-remaining-amount detecting unit which detects the remaining amount of ink in the first ink chamber.

In the ink jet recording apparatus according to the present invention, the ink in the sub-ink chamber is used up antecedent to the ink in the first ink chamber by printing. Thus, if the remaining amount of ink in the first ink chamber is less than or equal to a predetermined amount, then the ink-remaining-amount detecting unit is capable of assuredly detecting the absence of the remaining amount of ink in the sub-ink chamber. Accordingly, the sub-ink tank attached to the main ink tank is replaced with another based on the detected remaining amount of ink. This exchange can be carried out with suitable timing.

According to a still further aspect of the present invention, there is provided an ink jet recording apparatus wherein the ink-remaining-amount detecting unit optically detects a liquid level of the ink in the first ink chamber.

Since the ink-remaining-amount detecting unit optically detects the liquid level of the ink in the first ink chamber, the first ink chamber needs not to provide a special member thereinside and hence the present apparatus becomes simple in structure.

According to a still further aspect of the present invention, there is provided an ink jet recording apparatus wherein the ink-remaining-amount detecting unit applies light to the first ink chamber and detects a liquid level of ink therein from an attenuation factor of the light.

The ink-remaining-amount detecting unit applies the light to the first ink chamber and makes a decision as to the presence or absence of ink at a light-applied position based on the attenuation factor of the reflected light. Thus, the remaining amount of ink in the first ink chamber can be detected with satisfactory accuracy. Further, unsuitable ink can be detected by finely setting the attenuation factor. Thus when the unsuitable ink is detected, the present detecting unit may be configured so as to encourage the exchange of the sub-ink tank, main ink tank and recording head.

According to a still further aspect of the present invention, there is provided an ink jet recording apparatus wherein the connecting unit includes at least one pipe mounted to the main ink tank and having one end open within the first ink chamber and the other end provided with a transverse hole, a cover member which is mounted to the main ink tank and which hermetically seals the pipe from the outside and exposes the other end of the pipe to the outside by the action of an external force, and a seal member which is provided in the sub-ink tank and which hermetically seals the sub-ink chamber from the outside and allows the exposed pipe to hermetically enter the sub-ink chamber when the sub-ink tank is pressed toward the main ink tank.

When no sub-ink tank is mounted to the main ink tank, the pipe of the main ink tank is hermetically sealed from the outside with the cover member. Therefore, the vacuum state of the first ink chamber is maintained and the ink is prevented from evaporating through the pipe. Further, since the sub-ink tank is also hermetically sealed with the seal member, no ink leaks from the sub-ink chamber.

Owing to the attachment of the sub-ink tank to the main ink tank in this condition, the cover member pressed to the sub-ink tank exposes the pipe to the outside and allows the other end (lateral hole) of the pipe to enter into the sub-ink tank. Thus, the first ink chamber and the sub-ink chamber are capable of communicating with each other in a hermetic (fluid-tight) state.

According to a still further aspect of the present invention, there is provided an ink jet recording apparatus including a main ink tank which is placed over a movable carriage provided with a print recording head and has a first ink chamber which holds ink supplied to the recording head therein in a state having a free surface, a sub-ink tank having a sub-ink chamber with ink held therein, and at least one connecting unit having plural communication paths which allow the first ink chamber and the sub-ink chamber to communicate with each other, and wherein air in the first ink chamber and the ink in the sub-ink chamber are interchanged with each other according to a differential pressure between respective head pressures developed in the plural communication paths of the connecting unit, whereby the ink is supplied from the sub-ink tank to the main ink tank.

The sub-ink chamber and the first ink chamber are connected to each other by the connecting unit through the plural communication paths, and the ink can be supplied from the sub-ink chamber to the first ink chamber according to the differential pressure between the head pressures developed in the plural communication paths.

Thus, the use of the differential pressure between the head pressures makes it possible to supply the ink from the sub-ink tank to the main ink tank without having to use a special ink supply unit.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages there will be better understood from the following description taken in connection with the accompanying drawings in which:

DESCRIPTION OF THE PREFERRED EMBODIMENTS

An ink jet recording apparatus according to a first embodiment of the present invention will hereinafter be described in detail with reference to the accompanying drawings.

Figure 1:
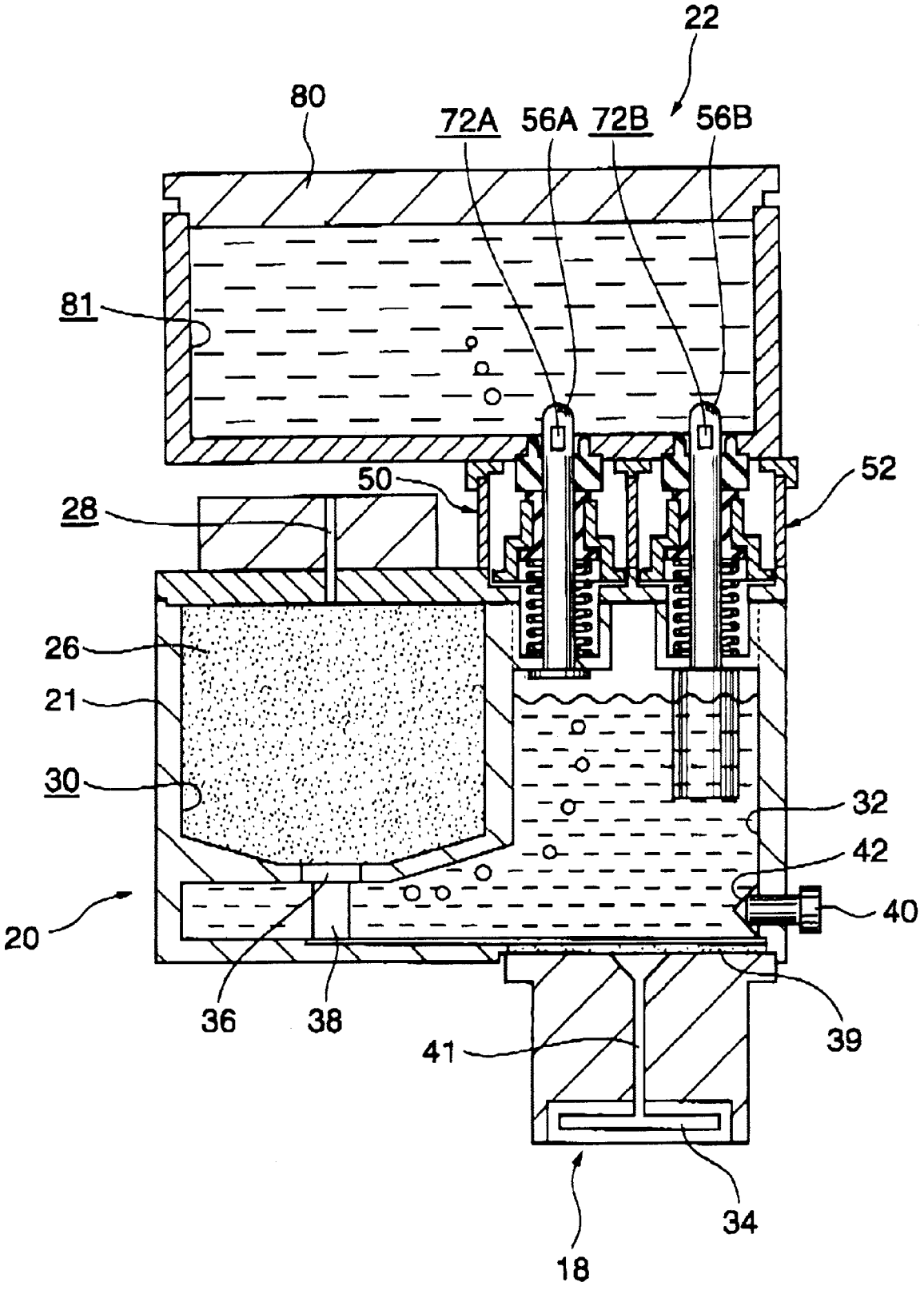
FIG. 1 is a vertical cross-sectional view showing a state in which an ink tank and a sub-ink tank according to a first embodiment of the present invention are connected to each other.
Figure 2:
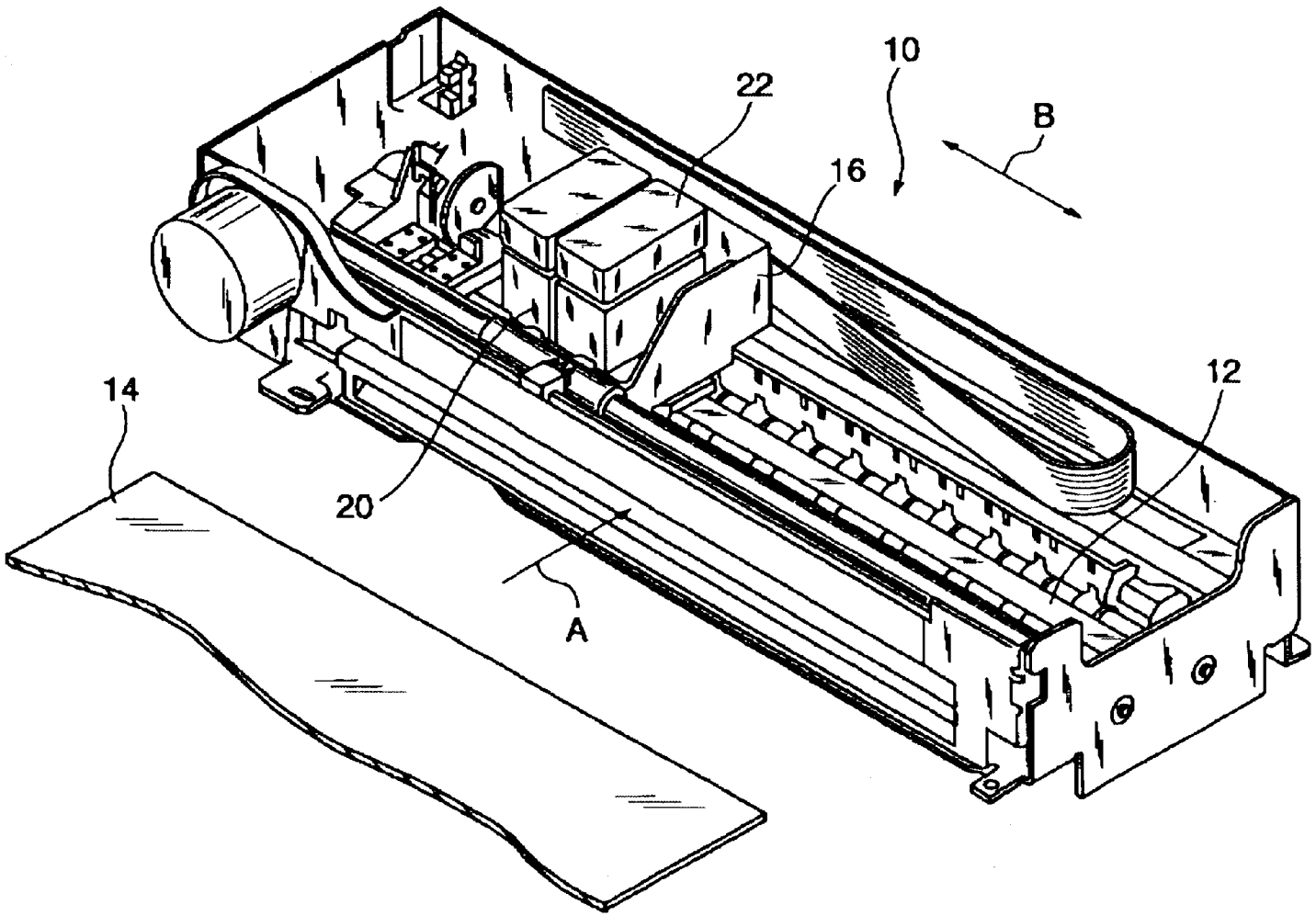
FIG. 2 is a perspective view illustrating an ink jet recording apparatus according to an embodiment of the present invention.
Figure 3:
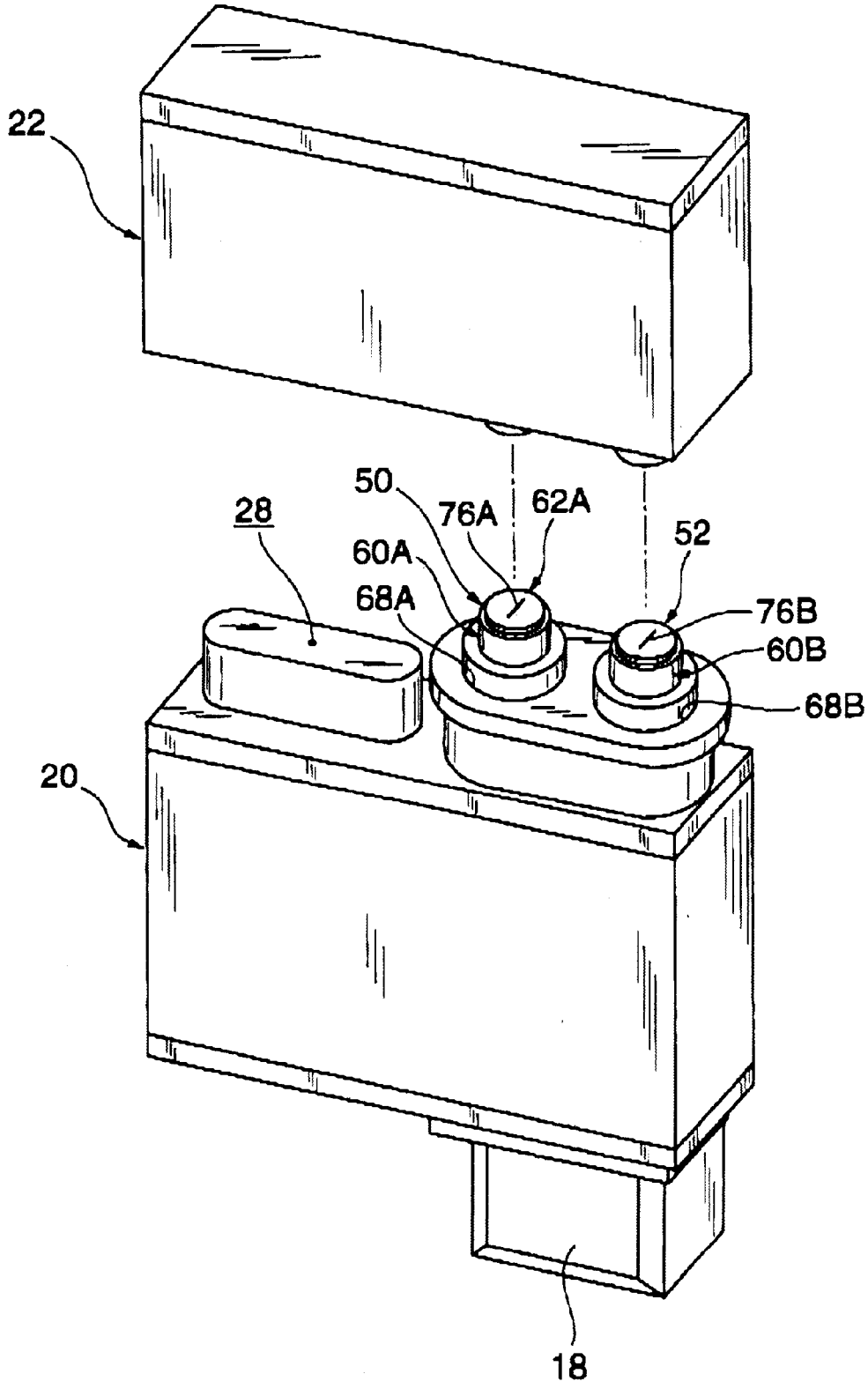
FIG. 3 is an exploded perspective view depicting the ink tank and the sub-ink tank according to the first embodiment of the present invention.

In an ink jet recording apparatus 10 as shown in FIG. 2, a carriage 16 movable in a main scanning direction (corresponding to the direction indicated by arrow B) intersecting a conveying or feeding direction (corresponding to a sub-scanning direction, i.e., the direction indicated by arrow A) of a sheet of paper 14 is placed above the paper 14 fed by a conveying or feeding roller 12. The carriage 16 includes a recording head 18 (see FIGS. 1 and 3) for discharging each individual ink of black, yellow, magenta and cyan to the paper 14, a main ink tank 20 formed integrally with the recording head 18, and a sub-ink tank 22 mounted above the main ink tank 20.

As shown in FIG. 1, the main ink tank 20 includes a first ink chamber 32 for holing ink in a free state, a second ink chamber 30 in which a capillary member 26 for holding ink is disposed and an air communication hole 28 is defined, and a head liquid chamber 34 having thereinside a head chip with an ink delivery or discharge hole defined therein, which are provided inside an enclosure or housing 21.

The housing 21 is formed of polypropylene capable of sufficiently controlling or restraining moisture permeability and gas permeability. However, another resin can be used if it is resistant to ink and capable of sufficiently restraining moisture permeability and gas permeability.

As the capillary member 26 placed within the second ink chamber 30, polyester felt is used. The polyester felt is capable of controlling a capillary force according to a change in density and is suitable because it is excellent even in resistance to ink. Of course, even porous macromolecular foam (polyurethane, melamine) or the like, or felt such as polypropylene, acrylic or the like other than polyester fiber may be used if it is capable of exhibiting a suitable capillary force between the same and ink and has resistance to ink.

The capillary member 26 functions as a negative pressure control part upon a variation in ambient environment. When, for example, ambient pressure is reduced and an ambient or surrounding temperature rises, air lying within the fist ink chamber 32 and air lying within the sub-ink tank expand. The capillary member 26 of the second ink chamber 30 absorbs ink lying within the first ink chamber 32 by such air expansion, thereby making it possible to apply suitable negative pressure to the recording head 18 even upon the change in environment.

In the present embodiment, the internal volumes of the respective chambers are designed assuming that an ink refluxable amount of the capillary member 26 is estimated to be 50% of the internal volume and the negative pressure can be maintained even when a change in environment is reduced to $2.63\times10^4$ Pa (0.26 atm) rather than $1.01\times10^5$ Pa (1.00 atm). In the present embodiment, the second ink chamber 30, the first ink chamber 32, the head liquid chamber 34, and the sub-ink tank 22 (sub-ink chamber 81) are respectively set to 5 ml, 8 ml, 2 ml and 7 ml.

In order to maintain the negative pressure of the first ink chamber 32 and supply ink to the head liquid chamber 34 even when, for example, the remaining amount of ink in the sub-ink tank (sub-ink chamber 81) is zero and the environmental change reduced to $2.63\times10^4$ Pa (0.26 atm) occurs, the following relational expression is required to be satisfied when the internal volume of the sub-ink tank is set as Vml.

50% ×(internal volume (corresponding to the internal volume of the capillary member 26) of the second ink chamber 30)$\geq$V/(1–0.26)–V Thus, when the volume of the second ink chamber 30 (capillary member 26) is set to 5 ml, the volume V of the sub-ink tank 22 (sub-ink chamber 81) results in V$\leq$7.1 ml from the above expression.

The main ink tank 20 is brought into cartridge form integrally with the recording head 18. When the life of the recording head 18 is closed, another for each cartridge replaces it. As to a new cartridge, all the second ink chamber 30, the first ink chamber 32 and the head liquid chamber 34 have been charged with ink.

A meniscus formation member 36 including a porous body having a small opening is placed at the bottom of the second ink chamber 30. The second ink chamber 30 and the first ink chamber 32 are in communication with each other through the opening. An ink guiding member 38 is placed at the bottom of the meniscus formation member 36. The ink held within the first ink chamber 32 is always supplied to the meniscus formation member 36 so that the meniscus formation member 36 is always wet with ink.

Owing to such a configuration, when the ink is consumed by printing and thereby the negative pressure of the first ink chamber 32 increases, air flows into the second ink chamber 30 through the air communication hole 28 and the ink with which the capillary member 26 is impregnated, flows into the first ink chamber 32 by its atmospheric pressure. Further, when the ink with which the capillary member 26 is impregnated is exhausted, the air introduced through the air communication hole 28 reaches the opening of the meniscus formation member 36. An ink meniscus film is formed in the opening and expands inside the first ink chamber 32 in convex form owing to the difference in pressure between the second ink chamber 30 and the first ink chamber 32, thereby leading to its breakage. After that, the air (bubbles) is supplied to the interior of the first ink chamber 32 to thereby keep a negative-pressure state of the first ink chamber 32 constant. On the other hand, since the opening at which the ink meniscus film is broken is supplied with the ink from the ink guiding member 38, the ink meniscus film is regenerated soon. Thus, the air is continuously introduced into the first ink chamber 32 so as to prevent the negative-pressure state thereof from damaging.

The head liquid chamber 34 is in communication with the first ink chamber 32 through a filter 39. Namely, ink delivered from the head liquid chamber 34 is supplied from the first ink chamber 32 to the head liquid chamber 34 through the filter 39 and a supply path 41. Since the head liquid chamber 34 stores therein bubbles produced by heat of the recording head 18, it has a volume of about 2 ml in the present embodiment. In the present embodiment as well, a recording head part is formed by micro-fabricating a silicon wafer and a nozzle part has a resolution of about 600 dpi.

Incidentally, a prism 42 used for an optical liquid level sensor 40 is disposed at a portion below one side of the first ink chamber 32. The liquid level sensor 40 installed in the ink jet recording apparatus 10 applies light emitted from a light emitting diode to the prism 42 for the main ink tank 20 with respective colors, which is shifted by the carriage 16, and launches the reflected light into a phototransistor to thereby detect a liquid surface or level. Namely, when the ink exists on a reflection surface of the prism 42, the incident light is transmitted through the main ink tank 20 and not reflected therefrom. On the other hand, when no ink exists on the reflection surface of the prism 42, the reflection surface is designed so as to fully reflect the incident light. The liquid level sensor 40 detects a drop in the liquid level of ink as compared with the prism 42, i.e., a reduction in the remaining quantity of ink by launching the reflected light into the phototransistor.

Incidentally, the prism 42 formed in the main ink tank 20 may also be molded integrally with the housing 21. In this case, the prism 42 is identical in material to the housing 21.

Further, two ports 50 and 52 for connection of the sub-ink tank 22 are provided over the upper surface of the first ink chamber 32.

Figure 4:
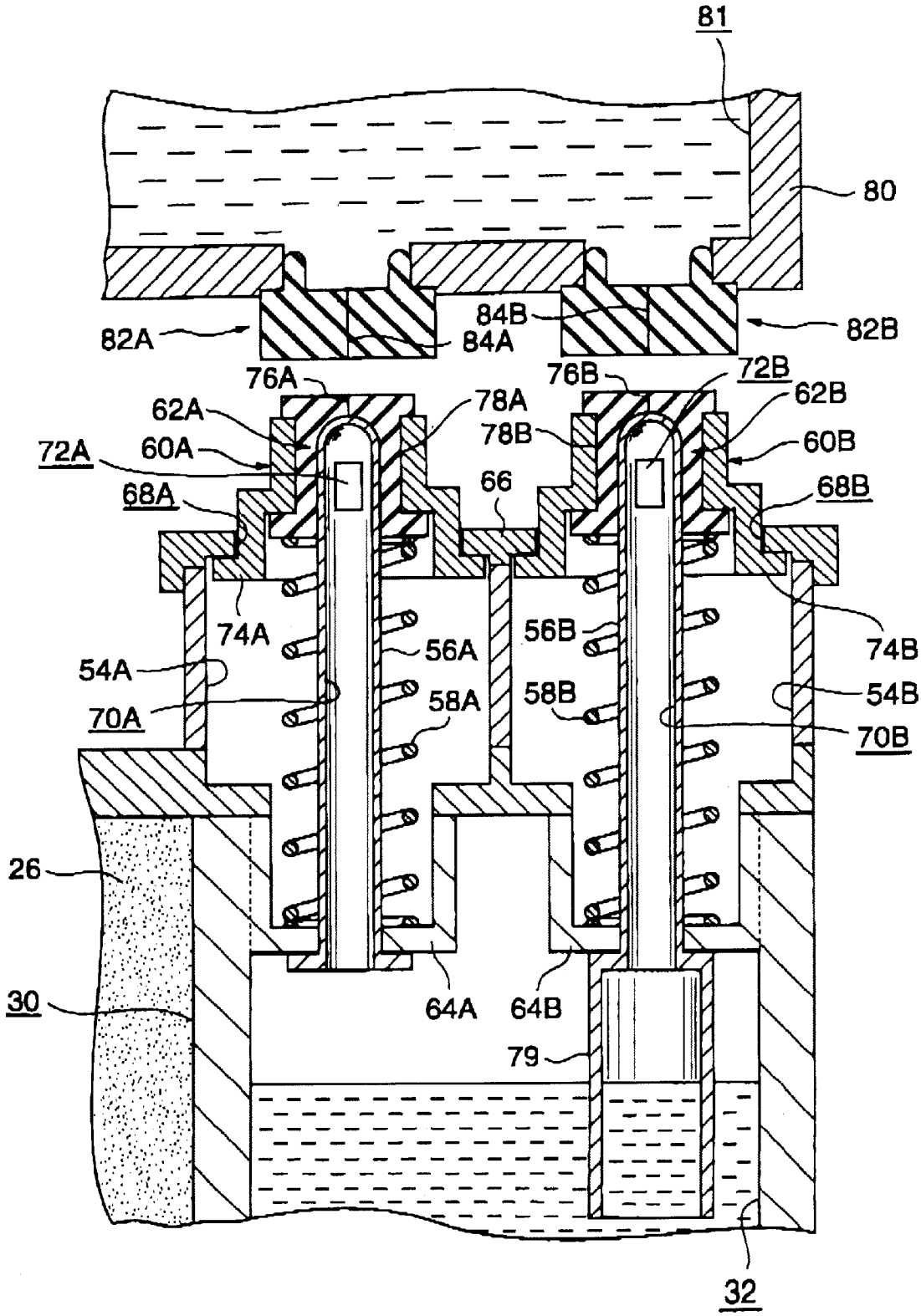
FIG. 4 is a cross-sectional view showing a portion where the ink tank and the sub-ink tank according to the first embodiment of the present invention are connected to each other.

As shown in FIG. 4, the port 50 includes a port chamber 54A formed above the first ink chamber 32, a pipe 56A extending through the interior of the port chamber 54A, a spring 58A wound around the pipe 56A, a support member 60A movable along the pipe 56A, and a seal member 62A movable together with the support member 60A.

The port chamber 54A has a support portion 64A through which the pipe 56A extends at its lower end and is fixed thereto. The pipe 56A fits in a hole defined in the support portion 64A. Further, a cover member 66 constituting the port chamber 54A has an opening 68A defined therein. The support member 60A and the seal member 62A project from the opening 68A together with a leading end of the pipe 56A.

The pipe 56A is opened at one end thereof (lower end as viewed in the drawing) and includes a path or passage 70A defined therein, which extends to the neighborhood of the leading end thereof. A transverse or lateral hole 72A is defined in the leading end of the passage 70A and communicates with the outside.

The spring 58A wound around the pipe 56A has a lower end supported by the bottom of the support portion 64A and an upper end brought into contact with the seal member 62A. Thus, the spring 58A upwardly urges the seal member 62A and the support member 60A fit onto the sides of the seal member 62A.

An engagement portion 74A formed over an outer peripheral surface of the support member 60A in protruded form at the lower end of the support member 60A is pressed against the lower side of the cover member 66 by the urging force of the spring 58A to thereby hermetically seal the opening 68A defined in the cover member 66.

The seal member 62A inserted inside of the support member 60A and fit to the inside thereof is formed of an elastic body such as rubber and has a slit 76A defined in its upper surface. Further, an inner peripheral surface of a cylindrical side 78A of the seal member 62A is press-fit or pressed against its corresponding outer peripheral surface of the pipe 56A, which is located in the neighborhood of the leading end thereof, to thereby hermetically seal the lateral hole 72A.

Thus, the transverse hole 72A defined in the leading end of the pipe 56A is shielded from outside by the support member 60A and the seal member 62A to thereby avoid the occurrence of evaporation and modification of ink in the transverse hole 72A.

Incidentally, when the seal member 62A is urged downward to thereby compress the spring 58A, the support member 60A and the seal member 62A are shifted downward to expose the leading end (lateral hole 72A) of the pipe 56A to the outside through the space corresponding to the slit 76A.

While the port 52 is also similar to the port 50, a pipe 56B is different in length form the pipe 56A. Namely, the pipe 56B has an extension 79 which extends below a support portion 64B. Thus, a lower end (open end) of the pipe 56B rather than the lower end (open end) of the pipe 56A is placed in a low position in the first ink chamber 32.

On the other hand, the inside diameters of the pipes 56A and 56B are designed so that the ink in the sub-ink tank 22 and in the ink tank (first ink chamber 32) can be exchanged therebetween by acceleration which acts on the main ink tank 20 and the sub-ink tank 22 by scanning of the carriage 16.

Figure 6:
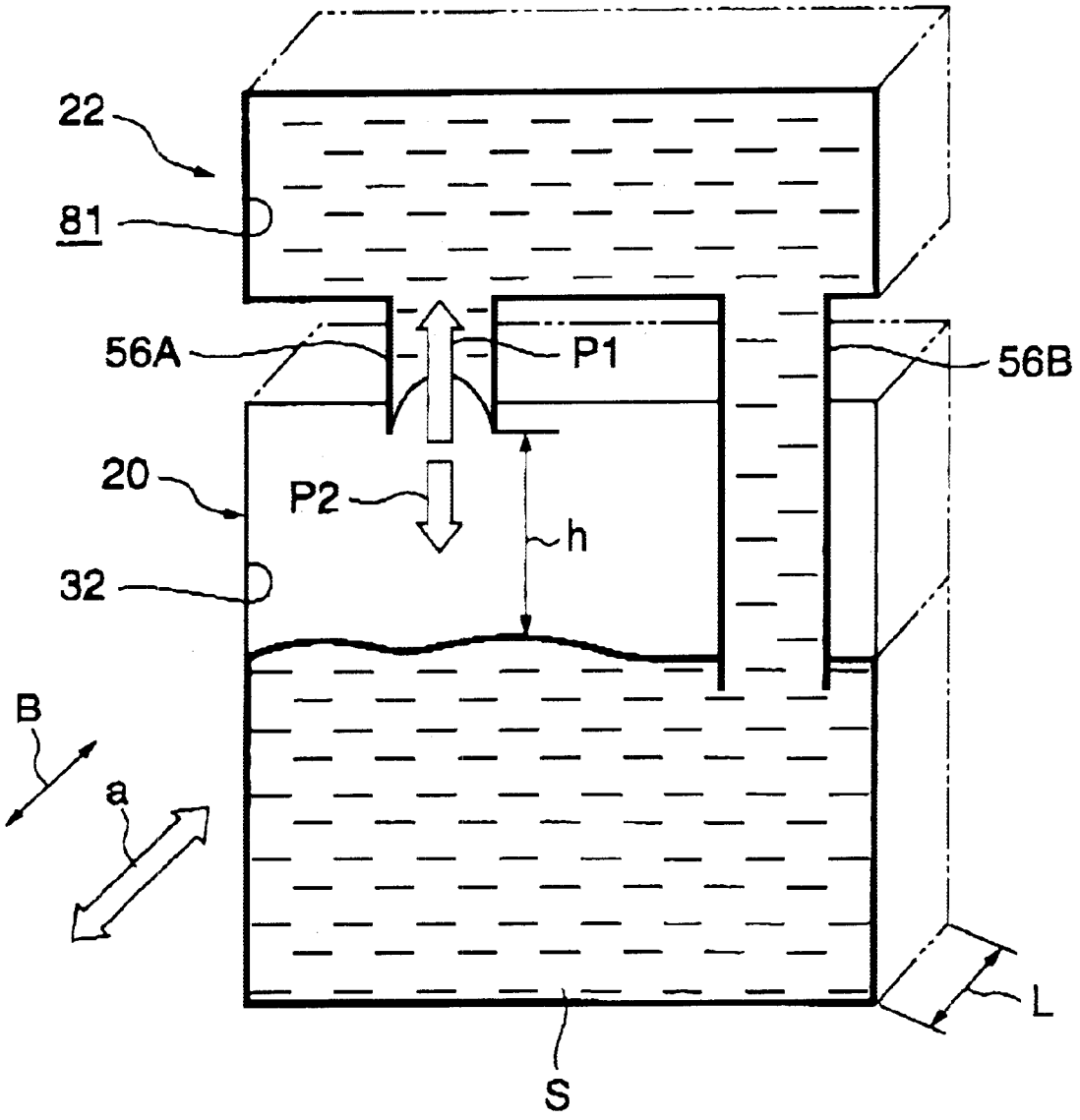
FIG. 6 is a conceptual view for describing a condition for exchanging air and ink between an ink tank and a sub-ink tank according to the present invention.

The principle of the exchange thereof will be explained in brief with reference to FIG. 6. Ink and air exist in the first ink chamber 32, and the liquid level of the ink is placed below the lower end of the pipe 56A and placed above the lower end of the pipe 56B. Incidentally, the interface between the ink and air, which is maintained by the surface tension of the ink, is formed at the lower end of the pipe 56A. Thus the pipe 56B is being charged with the ink.

In this condition, an acceleration a acts on the ink of the first ink chamber 32 by the scanning of the carriage 16. A force, which acts on the ink-air interface at this time, will be examined.

Namely, assuming that a pressure developed in the pipe 56A by a level height or elevated difference in ink is defined as P1, a pressure under which an interfacial tension between the ink and each pipe is developed at the lower end of the pipe 56A, is defined as P2, and a change in pressure, which is produced by the acceleration of the carriage 16, is defined as P3, they are represented as follows:

$$P1=\rho gh \tag{1}$$

$$P2=\pi d(\gamma \cos \theta 1)/(\gamma d^2/4)=4\gamma\cos \theta 1/d \tag{2}$$

$$P3=\rho SLa/S=\rho La \tag{3}$$

where ρ: ink density g: gravitational acceleration h: height from liquid level of ink in first ink chamber 32 to lower end of pipe 56A d: diameter of pipe section (circle or round)

γ: ink surface tension

θ1: contact angle

S: ink area of first ink chamber 32 orthogonal to main scanning direction

L: length of first ink chamber 32 in main scanning direction (direction indicated by arrow B)

a: acceleration of carriage 16 in main scanning direction (direction indicated by arrow B)

Also assuming that the force of adhesion of ink to each pipe is maximum (θ1=0°), P2 is derived from the expression (2) as follows:

$$P2=4\gamma/d \tag{4}$$

A condition for interchanging the air in the first ink chamber 32 and the ink in the sub-ink chamber 81 with each other is given as P1+P3≥P2. Accordingly, the following expression is derived from the expressions (1), (3) and (4):

$$\rho gh+\rho La\geq 4\gamma/d \tag{5}$$

By rewriting the expression (5), the following condition can be drawn.

$$d\geq 4\gamma/(\gamma gh+\gamma La) \tag{6}$$

It is understood from the above result that a pipe having an inside diameter set as large as possible may desirably be installed to accelerate or quicken the replacement or exchange of ink. However, if the pipe large in side diameter is placed, it is difficult to maintain hermeticity (fluid tightness) by slit valves 82A and 82B of the sub-ink tank 22.

In the present embodiment, the pipe is fabricated with the inside diameter thereof as $\phi$2.0 mm. When the carriage acceleration a, the ink surface tension $\gamma$, the ink density $\rho$, and the length of the first ink chamber in the main scanning direction are set at 9.8 m/sec$^2$, 40 mN/m, 1100 kg/m$^3$, and 10 mm respectively, a satisfactory ink exchange can be achieved even when the level difference of elevation h is 0 mm.

The sub-ink tank 22 mounted above the main ink tank 20 stores ink in the sub-ink chamber 81 formed inside a housing or enclosure 80 including a polypropylene resin in a free state as shown in FIG. 1. As shown in FIG. 4, the slit valves 82A and 82B are provided on the lower surface of the housing 80. The slit valves 82A and 82B are respectively formed of an elastic member such as rubber and have slits 84A and 84B centrally defined therein.

The slits 84A and 84B of the slit valves 82A and 82B are normally closed. They hold a hermetic state of the sub-ink chamber 81 and prevent the leakage of ink. When the slit valves 82A and 82B of the sub-ink tank 22 are pressed against the ports 50 and 52 to guide out the leading ends of the pipes 56A and 56B from the slits 76A and 76B of the seal members 62A and 62B, the slits 84A and 84B of the slit valves 82A and 82B are respectively opened to insert the leading ends of the pipes 56A and 56B therein. Incidentally, since the slit valves 82A and 82B are being pressed against the sides of the pipes 56A and 56B, there is no fear of the leakage of ink from the sub-ink chamber 81 to the outside.

Incidentally, the slit valves 82A and 82B make use of rubber like an elastic body, preferably, butyl rubber in the embodiment.

The operation of the ink jet recording apparatus 10 constructed in this way will be explained.

First of all, the sub-ink tank 22 is mounted to the main ink tank 20 formed integrally with the recording head 18 upon fabrication at a factory. Namely, the slit valves 82A and 82B are respectively brought into contact with the ports 50 and 52. Further, the lower surface of the housing 80 of the sub-ink tank 22 is pressed so as to make contact with the cover member 66. As a result, the spring 58A in the port 50 is compressed to shift the support member 60A and the seal member 62A downward, whereby the leading end of the pipe 56A is exposed through the space corresponding to the slit 76A of the seal member 62A and the leading end (lateral hole 72A) of the pipe 56A enters the slit 84A of the slit valve 82A (see FIG. 5). Namely, the sub-ink chamber 81 and the first ink chamber 32 communicate with each other. Since, at this time, the slit valve 82A and the seal member 62A are pressed against the side of the pipe 56A, it is possible to reliably prevent the leakage of ink from the slit valve 82A or the inflow of air into the port chamber 54A.

In a manner similar even to the port 52, the leading end (transverse hole 72B) of the pipe 56B enters the sub-ink chamber 81 to thereby allow the sub-ink chamber 81 and the first ink chamber 32 to communicate with each other.

Thus, the sub-ink tank 22 and the main ink tank 20 are in communication. Incidentally, the pipes 56A and 56B are filled thereinside with the ink in an initial state.

When the ink in the first ink chamber 32, which communicates with the head liquid chamber 34, is first used up or consumed and the level of negative pressure in the first ink chamber 32 increases, the ink is supplied from the capillary member 26 of the second ink chamber 30 to the first ink chamber 32 to control the negative pressure of the first ink chamber 32 to within a predetermined range in a normal print state. At this time, the control on the negative pressure of the first ink chamber 32 is performed by a capillary force of the capillary member 26.

Further, when the ink in the capillary member 26 is exhausted, the air in the second ink chamber 30 ruptures the ink meniscus film formed in the opening of the meniscus formation member 36 and enters the first ink chamber 32 in the form of air bubbles to thereby keep a vacuum state of the first ink chamber 32 constant. Incidentally, the ink meniscus film is promptly regenerated based on the ink supplied to the meniscus formation member 36 by the ink guiding member 38. It is thus possible to prevent damage of the vacuum state due to the continuous introduction of air into the first ink chamber 32. As a result, the ink is stably delivered from the head liquid chamber 34.

Incidentally, acceleration and deceleration act on the carriage 16 at both ends thereof as viewed in a scanning direction, according to the scanning (direction indicated by arrow B) of the carriage 16. Since the inside diameters d of the pipes 56A and 56B are formed so as to meet the expression (6) here, pressure distributions of the first ink chamber 32 and the sub-ink chamber 81, each of which holds the ink in the free state, change according to the acceleration and deceleration, whereby the air stored above the first ink chamber 32 and the ink in the sub-ink chamber 81 are interchanged with each other.

Further, the placement of the two pipes 56A and 56B different in length (in lower-end open position) from each other causes a level height difference b in ink. When the level of the ink in the first ink chamber 32 is reduced to some degree or more, the ink-level height differential pressure P1 becomes larger than the pressure P2 at which the capillary force of the ink lying within the pipe 56A is produced, thus making it possible to interchange the ink in the sub-ink chamber 81 and the air in the first ink chamber 32 with each other in one stroke. While the negative pressure of the first ink chamber 32 is apt to greatly vary at this time, the capillary member 26 of the second ink chamber 30 is allowed to absorb the amount of an increase in ink to thereby cause the negative pressure to converge on within a suitable range.

When the liquid level of the ink in the first ink chamber 32 becomes lower than the lower end of the pipe 56B and falls below the prism 42 due to the exhaustion of the ink in the sub-ink tank 22 (sub-ink chamber 81) with the consumption of the ink, the incident light applied from the light emitting diode of the liquid level sensor 40 is fully reflected by the reflection surface, which in turn is launched into the phototransistor. Since the sub-ink tank 22 (sub-ink chamber 81) is in an empty state when a reduction in level (the absence of the remaining amount of ink) is detected, the ink jet recording apparatus 10 notifies the replacement of the sub-ink tank 22 with another to an operator. For instance, it is displayed on an unillustrated monitor, or a warning sound is produced for its replacement.

Figure 5:
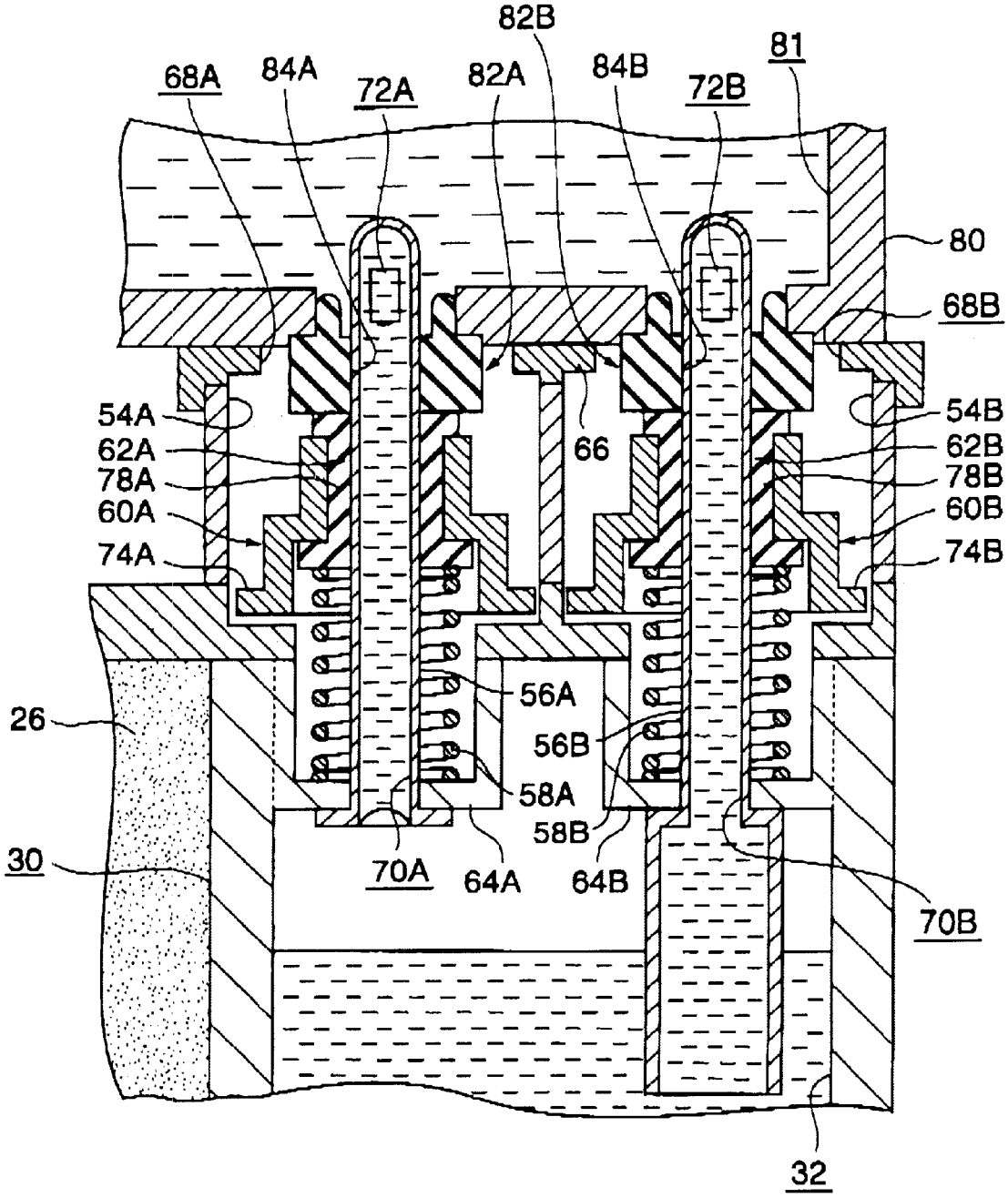
FIG. 5 is a cross-sectional view illustrating a state in which the ink tank and the sub-ink tank according to the first embodiment of the present invention are being connected to each other.

According to the notification, the operator detaches the used sub-ink tank 22 from the main ink tank 20 (see FIG. 5 to FIG. 4). In the port 50 of the main ink tank 20, the engagement portion 74A of the support member 60A urged by the spring 58A is pressed against the lower side of the cover member 66 and the slit 76A of the seal member 62A is closed. As a result, the port chamber 54A and the lateral hole 72A of the pipe 56A are brought into an air-tight state as viewed from the outside. It is thus possible to prevent evaporation of the ink from the pipe 56A (transverse hole 72A) or solidification of attached ink. Incidentally, the port 52 is also similar to the above.

Further, the slit valves 82A and 82B formed at the bottom of the sub-ink tank 22 respectively seal the slits 84A and 84B owing to a resilient force promptly after the withdrawal of the pipes.

In succession, a sub-ink tank 22 filled with ink is newly mounted to the main ink tank 20 to thereby supply the ink from the sub-ink chamber 81 from the lower end of the pipe 56B of the first ink chamber 32 to its upper position at a stroke. Thereafter, the ink is supplied while the negative pressure is being maintained at a suitable range according to the acceleration of the carriage 16 and the difference of elevation between the levels of ink in the pipes 56A and 56B.

The operation of the main ink tank 20 and sub-ink tank 22 at the time that an environment around the ink jet recording apparatus 10 changes, will now be explained.

Consideration will be given to the case where air exists in the first ink chamber 32 or the sub-ink chamber 81. When the temperature rises or the atmospheric pressure is reduced, the air relatively expands. As a result, the equilibrium of the meniscus formation member 36 is put out of balance and the ink is sucked through the ink guiding member 38 so as to be absorbed into the capillary member 26. Owing to such adsorption, the volume of the ink in the first ink chamber 32 is reduced and an increase due to the expansion of air is restrained, whereby the negative pressure is maintained at a suitable range.

Incidentally, when no air exists in the first ink chamber 32 and the sub-ink chamber 81, the influence of the expansion of air no occurs.

On the other hand, when the temperature is lowered or the atmospheric pressure rises, air is relatively contracted. Since, in this case, the supply of ink from the second ink chamber 30 to the first ink chamber 32 or the supply of air (bubbles) from the second ink chamber 30 is performed similarly upon the above consumption of ink, a vacuum state of the first ink chamber 32 can be controlled to a predetermined range.

Thus, the sub-ink tank 22 detachable from the main ink tank 20 formed integrally with the recording head 18 is attached to the ink jet recording apparatus 10 according to the present embodiment. Further, the ink in the sub-ink chamber 81 is supplied to the first ink chamber 32 owing to the replacement of the ink in the sub-ink tank 22 (sub-ink chamber 81) with the air in the main ink tank 20 (first ink chamber 32) by the acceleration of the carriage 16, or pressure based on the ink level height difference h developed between the pipes 56A and 56B. Accordingly, no particular power source or the like is required to supply the ink from the sub-ink tank 22 to the main ink tank 20. Thus, the ink jet recording apparatus 10 is simplified in structure.

After the absence of the remaining amount of ink is detected by the liquid level sensor 40, the empty sub-ink tank 22 is detached from the main ink tank 20 and a non-used sub-ink tank 22 is attached thereto and used. As a result, the main ink tank 20 is capable of continuing to use until the life of the recording head 18 is reached. Namely, it is possible to avoid wastage that the main ink tank 20 (capillary member 26 and the like) and the recording head 18 are abandoned because the remaining amount of ink in the main ink tank 20 becomes empty although the recording head 18 is available.

Since the main ink tank 20 is provided with the second ink chamber 30 with the capillary member 26 placed therein in addition to the first ink chamber 32, the negative pressure of the first ink chamber 32 can be held within a suitable range. Namely, when theliquid level of the ink in the first ink chamber 32 is lowered and the negative pressure thereof increases, the ink or bubbles (air) are supplied from the second ink chamber 30 to the first ink chamber 32 to control an increase in negative pressure. On the other hand, when the air in the first ink chamber 32 expands due to a rise in ambient temperature or a reduction in pressure or the like, the ink is absorbed into the capillary member 26 of the second ink chamber 30, so that the level of the negative pressure in the first ink chamber 32 can be controlled to within a predetermined range.

Since the lateral or transverse holes 72A and 72B are respectively hermetically sealed from the outside by the seal members 62A and 62B, the pipes 56A and 56B of the ports 50 and 52 can control or restrain evaporation of the ink in the first ink chamber 32 through the transverse holes 72A and 72B or solidification of the ink attached to the transverse holes 72A and 72B.

When the sub-ink tank 22 is attached to the main ink tank 20, the slits 76A and 76B of the seal members 62A and 62B and the slits 84A and 84B of the slit valves 82A and 82B are opened to allow the pipes 56A and 56B to enter the sub-ink chamber 81, thereby causing the sub-ink chamber 81 and the first ink chamber 32 to communicate with each other. Thus, since the slits 76A and 76B and the slits 84A and 84B are elastically pressed against the pipes 56A and 56B, hermeticity of the sub-ink chamber 81 is ensured and the leakage of ink is prevented from occurring.

Figure 7:
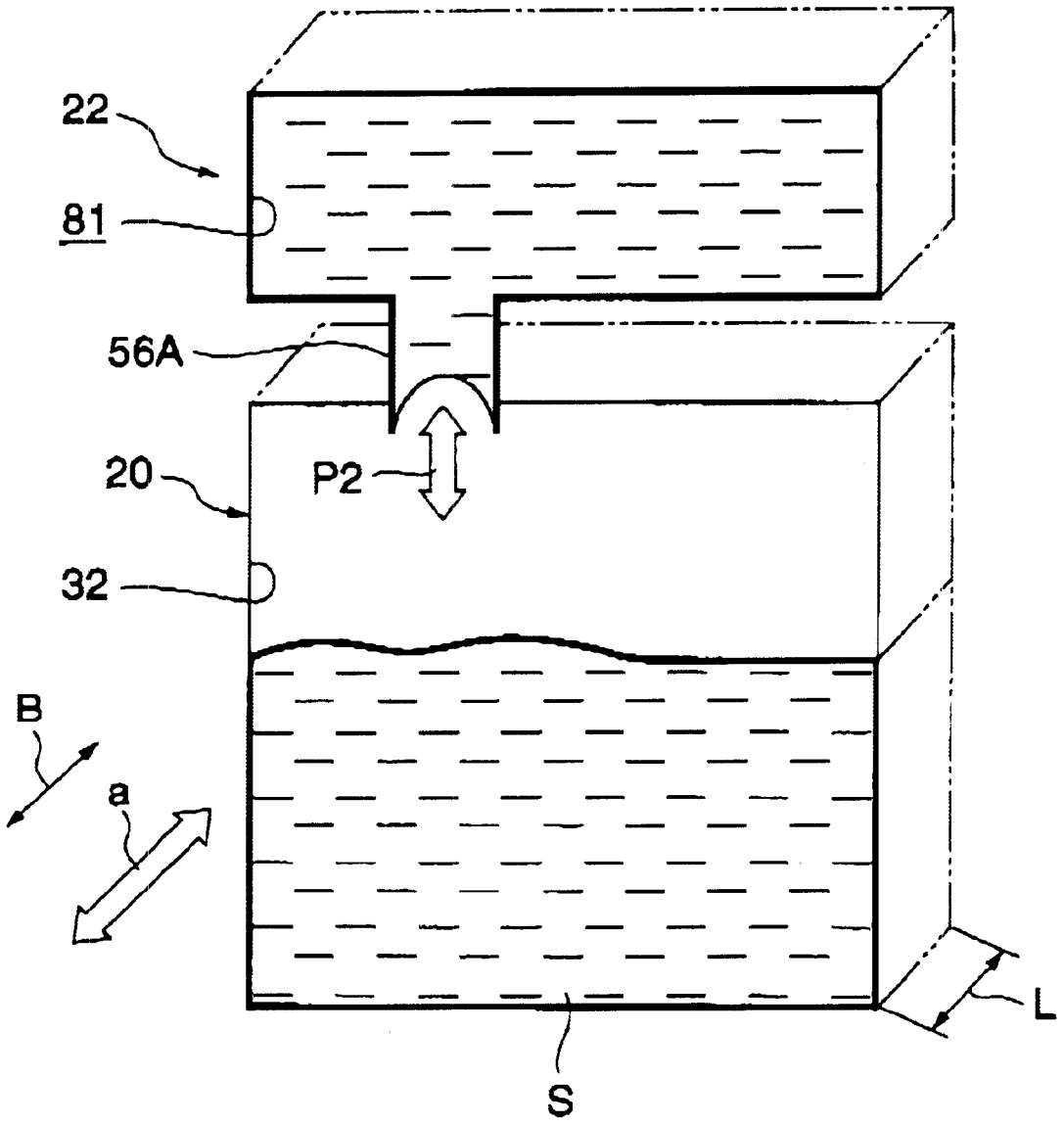
FIG. 7 is a conceptual view for describing a condition for exchanging air and ink between an ink tank and a sub-ink tank according to another example.

Incidentally, while plural pipes are installed to use a substitution promoting effect based on the pressure developed due to the ink level height difference in the present embodiment, even one pipe is capable of providing ink replaceable design according to the ink's change in pressure developed upon scanning of the carriage (see FIG. 7).

Assuming now that a pressure under which an interfacial tension between the ink and each pipe is developed at the lower end of the pipe 56A, is defined as P2, and a change in pressure, which is produced by the acceleration of the carriage 16, is defined as P3, they are represented as follows:

$$P2=\pi d(\gamma \cos \theta 1)/(\pi d^2/4)=4\gamma \cos \theta d \quad (2)$$

$$P3=\rho SLa/S=\rho La \quad (3)$$

where ρ: ink density d: diameter of pipe section (circle or round)

γ: ink surface tension

θ1: contact angle

S: ink area of first ink chamber 32 orthogonal to main scanning direction

L: length of first ink chamber 32 in main scanning direction (direction indicated by arrow B)

a: acceleration of carriage 16 in main scanning direction (direction indicated by arrow B)

Also assuming that the force of adhesion of ink to each pipe is maximum (θ1=0°), P2 is derived from the expression (2) as follows:

$$P2=4\gamma/d \quad (4)$$

A condition for interchanging the air in the first ink chamber 32 and the ink in the sub-ink chamber 81 with each other is given as P3≥P2. Accordingly, the following expression is derived from the expressions (3) and (4):

$$\rho La \geq 4\gamma/d \quad (5)$$

By rewriting the expression (5), the following condition can be drawn.

$$d \geq 4\gamma/\rho La \quad (6)$$

It is understood from the above result that a pipe having an inside diameter set as large as possible may desirably be installed to promote or accelerate the replacement or exchange of ink. However, if the pipe large in inside diameter is installed, it is difficult to maintain hermeticity (fluid tightness) by the slit valves 82A and 82B of the sub-ink tank 22.

If each pipe is fabricated with the inside diameter thereof as $\phi$2.0 mm in a manner similar to the present embodiment, then a satisfactory ink exchange can be achieved when the carriage acceleration a, the ink surface tension $\gamma$, the ink density $\rho$, and the length of the first ink chamber in the main scanning direction are set as 9.8 m/sec$^2$, 40 mN/m, 1100 kg/m$^3$, and 10 mm respectively.

Further, an ink optimum or suitability detecting unit for detecting ink's transmitted light is provided within the main ink tank 20 to identify each ink from an attenuation factor of the transmitted light. When an optical attenuation factor improper on a stationary or regular basis is detected, the ink suitability detecting unit may be set so as to judge that improper and defective ink has been used and accelerate the replacement of the sub-ink tank 22 and the main ink tank 20 with others.

An ink jet recording apparatus according to a second embodiment of the present invention will next be described with reference to FIG. 8. Incidentally, the same elements of structure as those employed in the first embodiment are identified by the same reference numerals and their detailed description will therefore be omitted.

Figure 8:
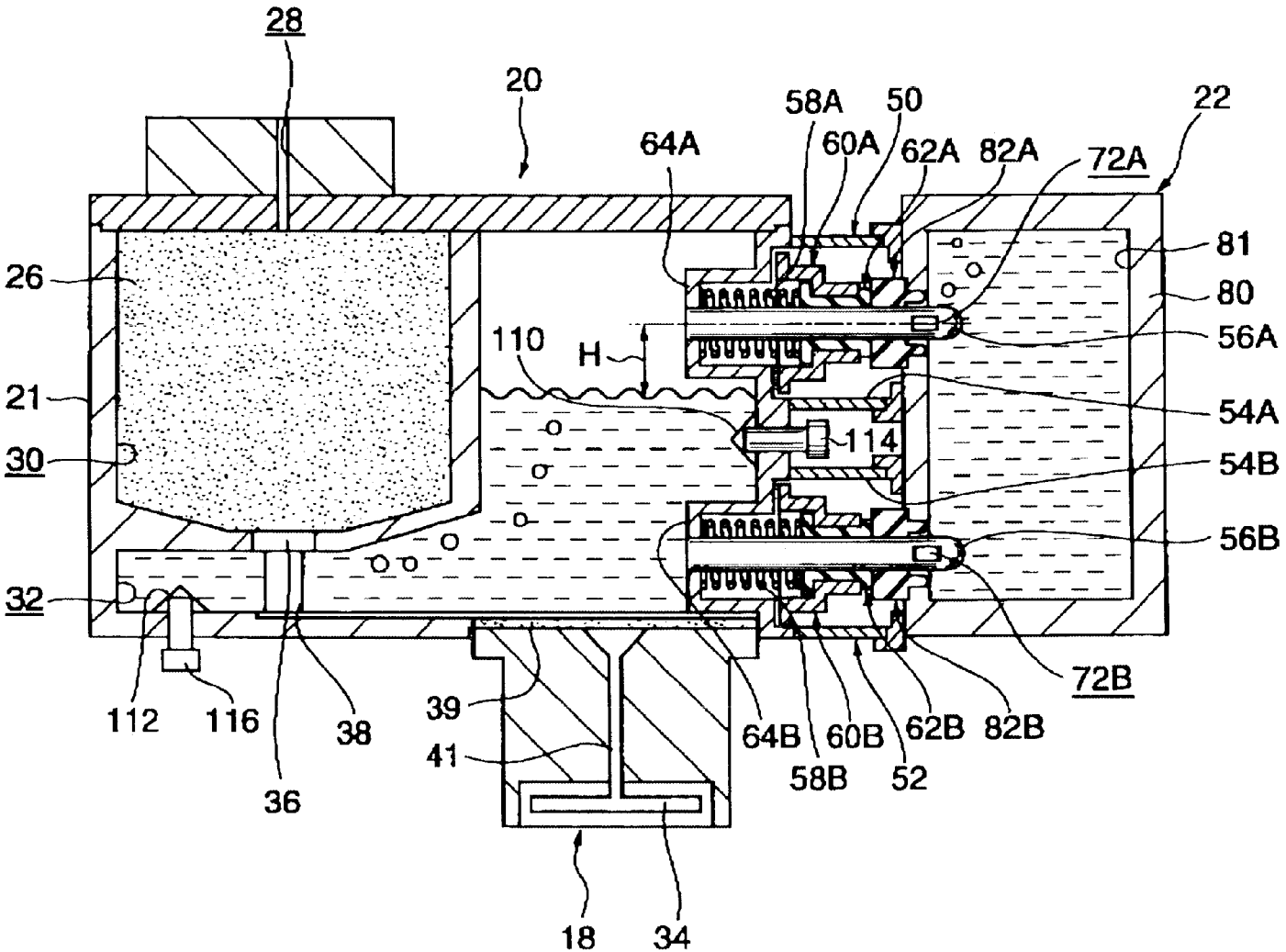
FIG. 8 is a vertical cross-sectional view showing a state in which an ink tank and a sub-ink tank according to a second embodiment of the present invention are connected to each other.

In the ink jet recording apparatus according to the present embodiment, a sub-ink tank 22 is attached to the side of a main ink tank 20 (see FIG. 8).

Ink in the sub-ink tank 22 (sub-ink chamber 81) is replaced with air in the main ink tank 20 (first ink chamber 32) in a manner similar to the first embodiment even in this case. However, when the liquid surfaces of ink in the first ink chamber 32 and the sub-ink chamber 81 fall below a pipe 56A, i.e., the air in the first ink chamber 32 and air in the sub-ink chamber 81 communicate with each other by the pipe 56A, the ink is consumed while the levels of the ink in the first ink chamber 32 and sub-ink chamber 81 are being held in an equal state.

Thus, operation and effects similar to those obtained in the first embodiment can be brought about even in the case of the attachment of the sub-ink tank 22 to the side of the main ink tank 20.

An ink jet recording apparatus according to a third embodiment of the present invention will be explained in succession with reference to FIGS. 9 and 10. Incidentally, the same elements of structure as those employed in the first and second embodiments are identified by like reference numerals and their detailed description will therefore be omitted.

In the ink jet recording apparatus according to the present embodiment, the sub-ink tank 22 is spaced away from the main ink tank 20 upon printing (scanning). The sub-ink tank 22 is attached to the main ink tank 20 as needed to replenish it with ink.

Figure 9:
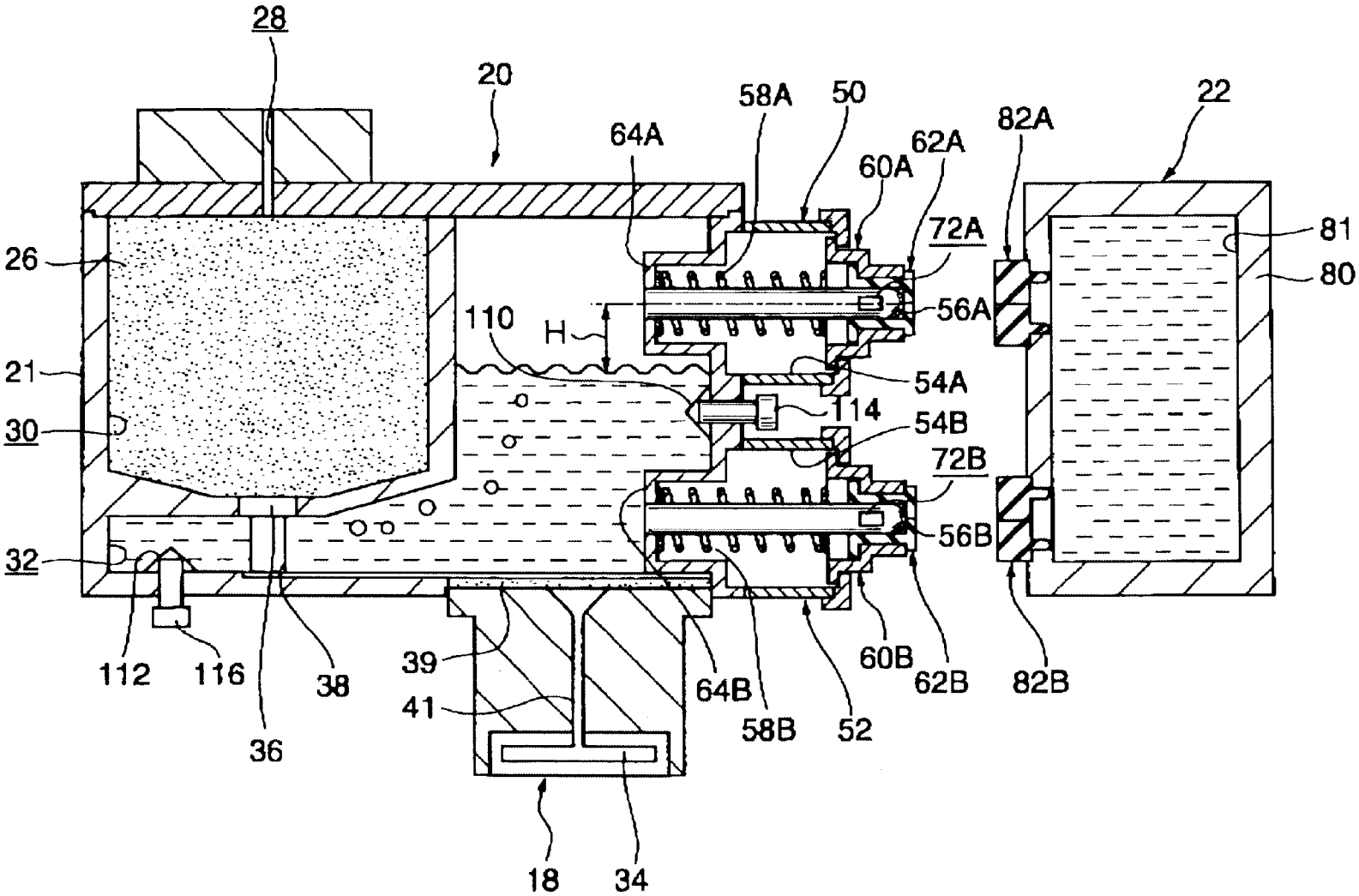
FIG. 9 is a vertical cross-sectional view illustrating an ink tank and a sub-ink tank according to a third embodiment of the present invention.
Figure 10:
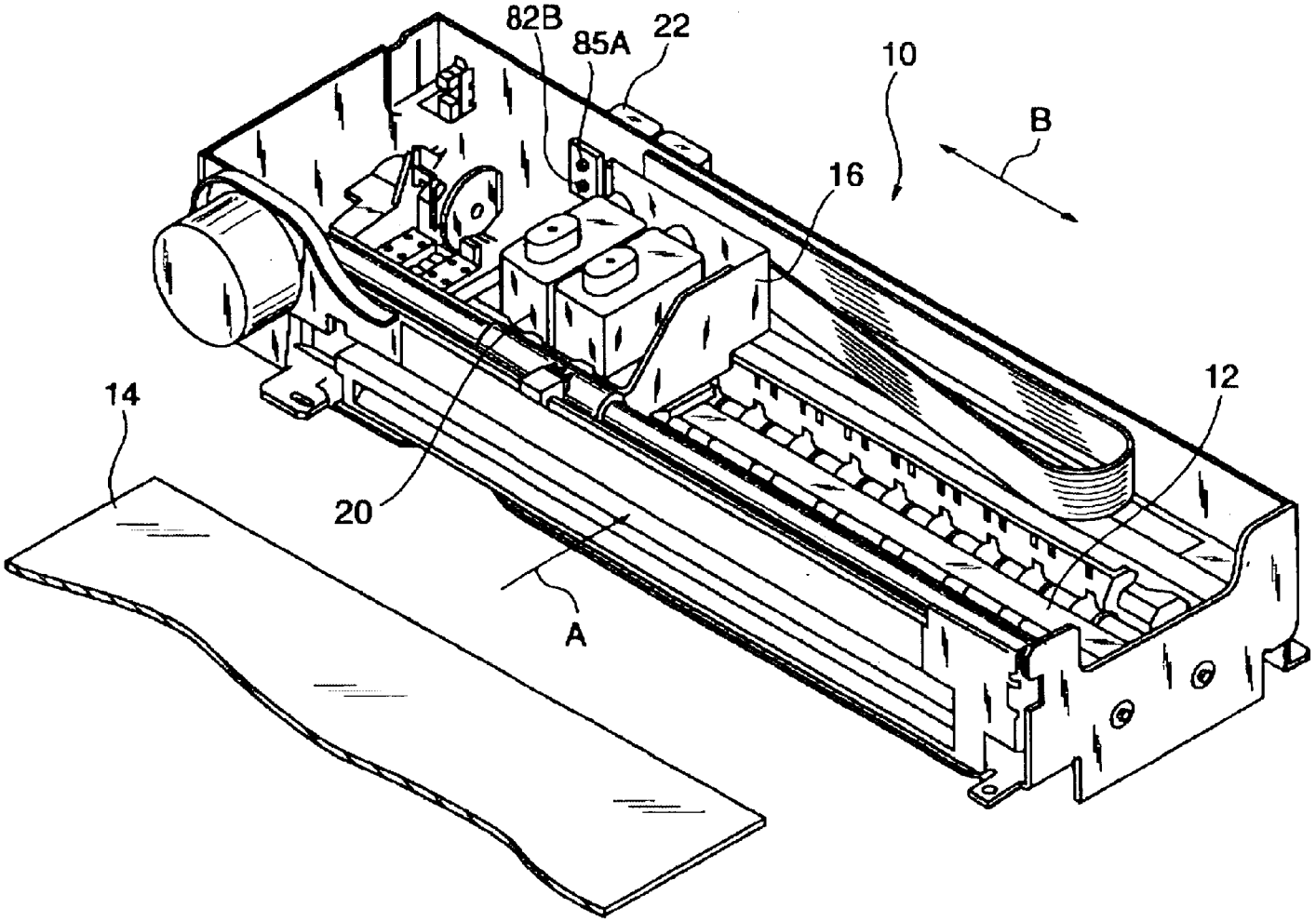
FIG. 10 is a perspective view depicting an ink jet recording apparatus according to the third embodiment of the present invention.

As shown in FIG. 9, the main ink tank 20 is similar in structure to that employed in the second embodiment. However, a prism 110 is provided over the side of a first ink chamber 32 so as to fall between a pipe 56A and a pipe 56B (at a position where the distance (height) from the pipe 56A is greater than an ink-air exchange height H). Further, a prism 112 is provided at the bottom of the first ink chamber 32.

On the other hand, the sub-ink tank 22 can be placed in an arbitrary position if placed in a position along a scanning direction (direction indicated by arrow B) of the main ink tank 20 (carriage 16) in the ink jet recording apparatus 10. However, the sub-ink tank 22 may preferably be provided in a home position as in the present embodiment (see FIG. 10). The sub-ink tank 22 can be moved forward and backward by an unillustrated driving unit in a direction (direction indicated by arrow A) orthogonal to a scanning direction as viewed from the home position.

The operation of the ink jet recording apparatus 10 configured in this way will be explained.

Only the main ink tank 20 is scanned by the carriage 16 to perform printing. When an optical liquid level sensor 114 detects that the liquid level or surface of ink is lowered as viewed from the position of the prism 110, the carriage 16 is returned to its home position and the sub-ink tank 22 is pressed against ports 50 and 52 of the main ink tank 20 by the unillustrated driving unit. As a result, the first ink chamber 32 and a sub-ink chamber 81 communicate with each other through the pipes 56A and 56B. Since, at this time, the height between the pipe 56A and the liquid level of ink in the first ink chamber 32 is greater than an ink-air exchange height H, the ink is supplied from the sub-ink chamber 81 to the first ink chamber 32 according to the difference in head pressure. After the supply of the ink thereto, the sub-ink tank 22 is separated from the main ink tank 20 to perform printing again.

When the liquid surface or level of ink in the sub-ink chamber 81 is lowered and thereby becomes equal to the liquid level of the ink in the main ink chamber 32 owing to the repetition of such ink supply, the ink cannot be supplied so that the liquid surface of ink does not rise till the position of the prism 110. In this case, an unillustrated control unit judges both ink liquid surfaces as equal to each other and stops the supply of the ink to resume a print operation.

The print operation is continuously carried out until the absence of ink is detected by an optical liquid level sensor 116 through the prism 112 provided at the bottom of the first ink chamber 32. When the optical liquid level sensor 116 has detected the absence of ink (when the ink in the first ink chamber 32 is substantially empty), the carriage 16 is returned to its home position to supply the ink from the sub-ink tank 22. Since, in this case, a difference occurs between the liquid surfaces or levels of the ink in the first ink chamber 32 and the sub-ink chamber 81, the ink is smoothly supplied from the sub-ink chamber 81 to the first ink chamber 32 according to the difference in head pressure.

Incidentally, when a detected signal indicative of the absence of ink, which is produced from the optical liquid level sensor 116 lasts for a predetermined time or more, the sub-ink tank 22 is judged as empty and a message or the like for quickening or accelerating the exchange of the sub-ink tank 22 is displayed.

Owing to such a configuration, the ink can reliably be supplied from the sub-ink tank 22 to the main ink tank 20. Incidentally, other negative-pressure control functions or the like are similar to those employed in the first embodiment.

Figure 11A:
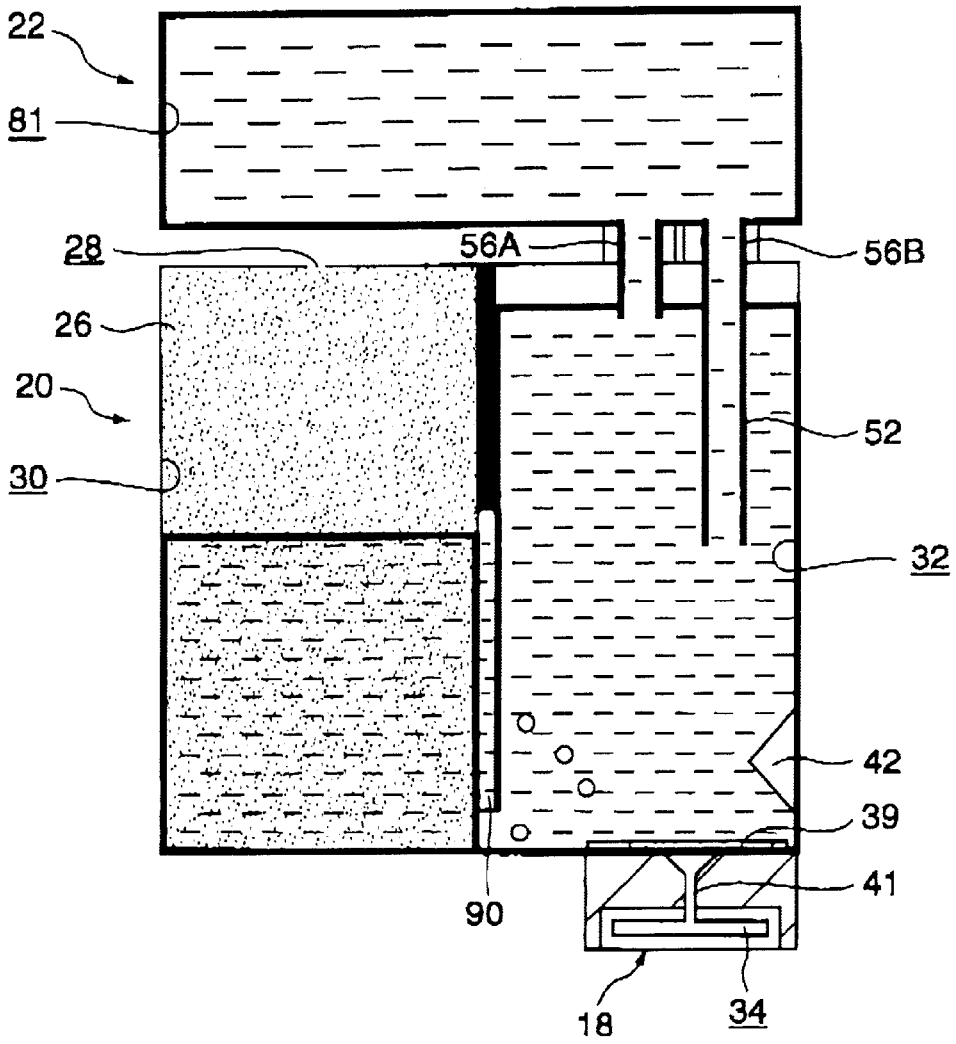
FIG. 11A is a vertical cross-sectional view showing a state in which an ink tank and a sub-ink tank according to a fourth embodiment of the present invention are connected to each other.
Figure 11B:
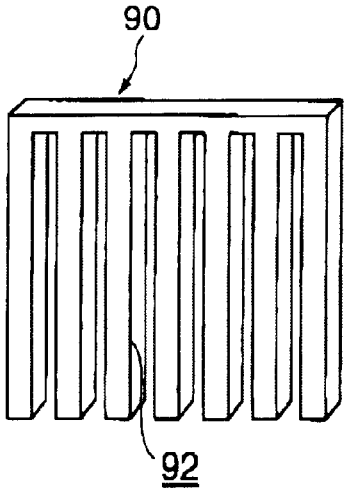
FIG. 11B is a perspective view of a slit member.

An ink jet recording apparatus according to a fourth embodiment of the present invention will next be described with reference to FIGS. 11A and 11B. The same elements of structure as those employed in the first embodiment are identified by the same reference numerals and their detailed description will therefore be omitted.

In the present embodiment, a slit member 90 is formed between a second ink chamber 30 provided with a capillary member 26 and a first ink chamber 32. As shown in FIG. 11B, plural slits 92 extending in a vertical direction are defined in the slit member 90. They are placed in an inner direction as viewed in FIG. 11A.

Owing to the attachment of a sub-ink tank 22 to a main ink tank 20 configured in this way, ink can be supplied from a sub-ink tank 81 to the first ink chamber 32 according to the acceleration of a carriage 16 and the difference of elevation between the liquid surfaces or levels of ink in pipes 56A and 56B.

Figure 12:
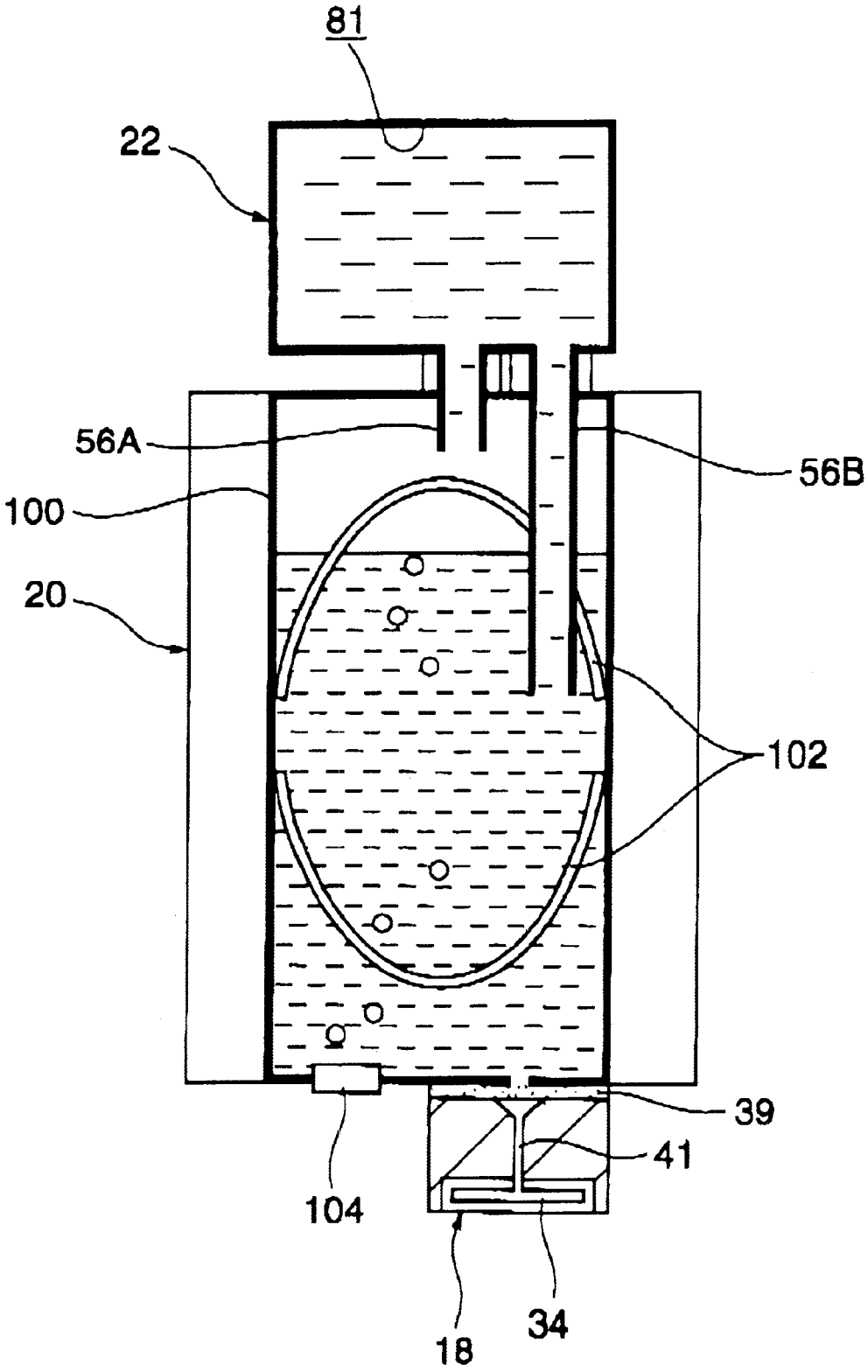
FIG. 12 is a vertical cross-sectional view showing a state in which an ink tank and a sub-ink tank according to a fifth embodiment of the present invention are connected to each other.

An ink jet recording apparatus according to a fifth embodiment of the present invention will further be described with reference to FIG. 12. The same elements of structure as those employed in the first embodiment are identified by the same reference numerals and their detailed description will therefore be omitted.

A flexible ink bag 100 is placed in a main ink tank 20 according to the present embodiment. The ink bag 100 is provided thereinside with a pair of plate springs 102, which contracts the ink bag 100 by negative pressure developed according to the consumption of ink to thereby prevent a decrease in negative pressure thereof and control the negative pressure of the ink bag 100 to a predetermined range.

A bubble generator 104 having a small hole defined therein, which communicates with the outside, is placed below the ink bag 100. When the negative pressure excessively increases, the bubble generator 104 introduces air from the outside to generate bubbles, thereby controlling negative pressure which increases with the consumption of ink, to a predetermined range.

Owing to the attachment of a sub-ink tank 22 to the main ink tank 20 configured in this way, ink can be supplied from a sub-ink tank 81 to a first ink chamber 32 according to the acceleration of a carriage 16 and the difference of elevation between the liquid surfaces or levels of ink in pipes 56A and 56B.

Incidentally, the first through fifth embodiments provide the capillary member (felt, porous body foam), the meniscus formation member, the bubble generator having the small hole defined therein, the slit, etc. as negative pressure generating units. However, if those capable of generating negative pressure and maintaining it at suitable pressure are used in addition to them, then other configurations such as a differential pressure regulating valve, etc. may be used. There are also provided the capillary member (felt, porous body foam) and the ink bag urged by the plate springs as negative pressure holding units. However, the negative pressure holding units are not limited to those employed in the first through fifth embodiments if those each of which performs a negative pressure holding function, such as an air bag, which is urged by springs and communicates with outside air, a parallel flat plate, etc. are used in addition to the above.

In the first, second, fourth and fifth embodiments, the sub-ink tank 22 is attached to the carriage 16 and scanned together with the main ink tank 20. However, the sub-ink tank 22 is placed outside the carriage 16 and connected to the main ink tank 20 by a tube or the like. In this condition, the ink may be supplied from the sub-ink tank 22 according to the acceleration which acts on the main ink tank 20.

Since the ink can be supplied from a sub tank to an ink tank according to acceleration based on scanning of the sub tank by a movable carriage in an ink jet recording apparatus according to the present invention as described above, an ink supply system can be simplified in structure.

While the present invention has been described with reference to the illustrative embodiments, this description is not intended to be construed in a limiting sense. Various modification of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. An ink jet recording apparatus, comprising:

a main ink tank which is placed over a movable carriage provided with a print recording head and has a first ink chamber which holds ink supplied to the recording head in a state having a free surface;

a sub-ink tank which has a sub-ink chamber with ink held therein; and a connecting unit which has at least one communication path allowing the first ink chamber and the sub-ink chamber to communicate with each other, wherein air in the first ink chamber and the ink in the sub-ink chamber are interchanged with each other through the communication path due to a change in pressure in the first ink chamber caused by acceleration or deceleration in scanning of the movable carriage, whereby the ink is supplied from the sub-ink tank to the main ink tank.

2. The ink jet recording apparatus as claimed in claim 1, wherein the connecting unit has plural communication paths, and the air in the first ink chamber and the ink in the sub-ink chamber are interchanged with each other due to a difference between head pressures in the plural communication paths to thereby supply the ink from the sub-ink tank to the main ink tank.

3. The ink jet recording apparatus as claimed in claim 2, wherein the plural communication paths have height differences at open ends in the first ink chamber.

4. The ink jet recording apparatus as claimed in claim 1, wherein the sub-ink tank is placed over the movable carriage and detachably mounted to the main ink tank.

5. The ink jet recording apparatus as claimed in claim 1, wherein the main ink tank has a negative pressure control unit which controls the first ink chamber for supplying the ink to the print recording head to a predetermined vacuum state.

6. The ink jet recording apparatus as claimed in claim 5, wherein the negative pressure control unit is a second ink chamber which sucks the ink in the first ink chamber, the ink being corresponding to expansion of the air in the first ink chamber and sub-ink chamber, when an ambient environment thereof changes, while keeping the vacuum state.

7. The ink jet recording apparatus as claimed in claim 5, wherein the negative pressure control unit comprises, a capillary member which holds the ink therein;

a second ink chamber which holds the capillary member therein and has an air communication hole; and a meniscus formation member which is placed at a portion where the first ink chamber and the second ink chamber communicate with each other, and forms ink meniscus.

8. The ink jet recording apparatus as claimed in claim 6, wherein a negative-pressure maintain capacity of the second ink chamber defined as Xml and an amount of expansion of the air in each of the first ink chamber and the sub-ink chamber, when the ambient environment changes, defined as Yml satisfy the relation $X \gtrsim Y$.

9. The ink jet recording apparatus as claimed in claim 1, further including an ink-remaining-amount detecting unit which detects a remaining amount of ink in the first ink chamber.

10. The ink jet recording apparatus as claimed in claim 9, wherein the ink-remaining-amount detecting unit optically detects a liquid level of the ink in the first ink chamber.

11. The ink jet recording apparatus as claimed in claim 10, wherein the ink-remaining-amount detecting unit irradiates the first ink chamber with light and detects a liquid level of the ink therein from an attenuation factor of the light.

12. The ink jet recording apparatus as claimed in claim 1, wherein the connecting unit comprises:

a pipe which is mounted to the main ink tank and has one end opening within the first ink chamber and the other end provided with a transverse hole;

a cover member, mounted to the main ink tank, which hermetically seals the pipe from the outside and exposes the other end of the pipe to the outside by action of an external force; and a seal member, provided in the sub-ink tank, which hermetically seals the sub-ink chamber from the outside and allows the exposed pipe to hermetically enter the sub-ink chamber when the sub-ink tank is pressed toward the main ink tank.

13. An ink jet apparatus comprising:

a main ink tank which is placed over a movable carriage provided with a print recording head and has a first ink chamber which holds ink supplied to the recording head therein in a state having a free surface, wherein the print recording head is mounted directly under the free surface of the first ink chamber;

a sub-ink tank which has a sub-ink chamber with ink therein; and a connecting unit which has plural communication paths allowing the first ink chamber and the sub-ink chamber to communicate with each other, wherein air in the first ink chamber and the ink in the sub-ink chamber are interchanged with each other due to a difference between head pressures in the plural communication paths of the connecting unit, whereby the ink is supplied from the sub-ink tank to the main ink tank.

* * * * *